US008692820B2

(12) United States Patent
Liu

(10) Patent No.: US 8,692,820 B2
(45) **Date of Patent: *Apr. 8, 2014**

(54) ORGANIC LIGHT EMITTING DISPLAY AND METHOD FOR DRIVING THE SAME

(75) Inventor: Chun-Yen Liu, Hsin-Chu (TW)

(73) Assignee: Au Optronics Corporation, Hsin-Chu (TW)

( * ) Notice: Subject to any disclaimer, the term of this patent is extended or adjusted under 35 U.S.C. 154(b) by 639 days.

This patent is subject to a terminal disclaimer.

(21) Appl. No.: 12/955,365

(22) Filed: Nov. 29, 2010

(65) Prior Publication Data

US 2011/0273420 A1 Nov. 10, 2011

(30) Foreign Application Priority Data

May 10, 2010 (TW) ..... 99114858 A

(51) Int. Cl.
*G09G 5/00* (2006.01)

(52) U.S. Cl.
USPC ..... 345/211; 345/76

(58) Field of Classification Search
USPC ..... 345/76–83, 87; 257/59
See application file for complete search history.

(56) References Cited

U.S. PATENT DOCUMENTS

| | | | |
|---|---|---|---|
| 7,167,169 | B2 | 1/2007 | Libsch et al. |
| 7,623,097 | B2 | 11/2009 | Chung |
| 7,808,472 | B2 | 10/2010 | Park et al. |
| 7,924,253 | B2 | 4/2011 | Huang et al. |
| 8,072,570 | B2 | 12/2011 | Chang |
| 8,111,226 | B2 | 2/2012 | Tsai et al. |
| 2006/0176251 | A1 | 8/2006 | Park et al. |
| 2006/0267509 | A1 | 11/2006 | Yang |
| 2007/0211011 | A1 | 9/2007 | Lee |

FOREIGN PATENT DOCUMENTS

| | | | |
|---|---|---|---|
| CN | 101034523 | A | 9/2007 |
| CN | 101083062 | A | 12/2007 |
| JP | 2007-52432 | A | 3/2007 |
| TW | 200830008 | | 7/2008 |
| TW | M371900 | | 1/2010 |
| TW | 201007313 | | 2/2010 |
| WO | 03083815 | | 10/2003 |

OTHER PUBLICATIONS

English translation of abstract and pertinent parts of CN 101034523 A.
English translation of abstract and pertinent parts of CN 101083062 A.
English translation of abstract and pertinent parts of JP 2007-52432 A.
English translation of abstract and pertinent parts of TW 201007313 (published Feb. 16, 2010).
English translation of abstract and pertinent parts of TW M371900 (published Jan. 1, 2010).
English translation of abstract and pertinent parts of TW 200830008 (published Jul. 16, 2008).

*Primary Examiner* — Ricardo L Osorio
(74) *Attorney, Agent, or Firm* — McClure, Qualey & Rodack, LLP

(57) ABSTRACT

An organic light emitting display includes scan lines, row common electrodes and rows of pixels. The scan lines sequentially transmit scan signals. The row common electrodes disposed in parallel with the scan lines and sequentially transmit common voltage signals corresponding to the scan signals. The rows of the pixels are electrically coupled to the scan lines and the row common electrodes and sequentially receive the scan signals and the common voltage signals. A method for driving the organic light emitting display is also disclosed herein.

21 Claims, 7 Drawing Sheets

ORGANIC LIGHT EMITTING DISPLAY AND METHOD FOR DRIVING THE SAME

RELATED APPLICATIONS

This application claims priority to Taiwan Patent Application Serial Number 99114858, filed May 10, 2010, which is herein incorporated by reference.

BACKGROUND

1. Technical Field

The present disclosure relates to a display. More particularly, the present disclosure relates to an organic light emitting display.

2. Description of Related Art

Conventionally, an organic light emitting device has advantages such as spontaneous luminescence, wide viewing angle, high contrast ratio, low power consuming, high response speed, etc. Thus, the organic light emitting device is commonly applied in various flat-panel displays. For an active matrix organic light emitting diode (AMOLED) display, there are usually organic light emitting diodes and thin-film transistors (TFTs) included in pixels, and the organic light emitting diodes are driven by currents generated when the TFTs operate.

However, due to the process variation, TFTs may have different threshold voltages (Vth) from each other, and that will result in that the brightness of the organic light emitting diodes are not identical and the frame which is shown on the display has non-uniform brightness (e.g. mura) when the display shows images.

SUMMARY

In accordance with one embodiment of the present invention, an organic light emitting display is provided. The organic light emitting display includes a plurality of scan lines, a plurality of row common electrodes and a plurality of rows of pixels. The scan lines are configured for sequentially transmitting a plurality of scan signals. The row common electrodes are disposed in parallel with the scan lines, for sequentially transmitting a plurality of common voltage signals corresponding to the scan signals. The rows of pixels are electrically coupled to the scan lines and the row common electrodes, for sequentially receiving the scan signals and the corresponding common voltage signals.

In accordance with another embodiment of the present invention, a method for driving an organic light emitting display is provided, in which the organic light emitting display includes a plurality of rows of pixels, each row of the pixels includes a plurality of driving units and a plurality of light emitting devices, and the driving units are configured for driving the light emitting devices. The method includes the steps as follows. A first scan signal is transmitted to control the driving units in a first row of the pixels. A first common voltage signal corresponding to the first scan signal is transmitted to reverse bias the light emitting devices in the first row of the pixels. The first scan signal is de-asserted and a second scan signal is transmitted to control the driving units in a second row of the pixels. The first common voltage signal is de-asserted and a second common voltage signal corresponding to the second scan signal is transmitted to reverse bias the light emitting devices in the second row of the pixels.

In accordance with yet another embodiment of the present invention, an organic light emitting display is provided. The organic light emitting display includes a plurality of scan lines, a plurality of row common electrodes and a plurality of rows of pixels. The scan lines are configured for sequentially transmitting a plurality of scan signals. The row common electrodes are disposed in parallel with the scan lines, for sequentially transmitting a plurality of common voltage signals generated in accordance with the scan signals. The rows of the pixels are electrically coupled to the scan lines and the row common electrodes. Each row of the pixels include a plurality of light emitting devices and a plurality of driving units, in which first ends of the light emitting devices are electrically coupled to one of the row common electrodes and the driving units are configured for driving the light emitting devices. The rows of the pixels receive the scan signals and the corresponding common voltage signals row by row, such that the driving units in each row of the pixels are controlled by a corresponding one of the scan signals and the light emitting devices in each row of the pixels are reverse biased by a corresponding one of the common voltage signals.

It is to be understood that both the foregoing general description and the following detailed description are by examples, and are intended to provide further explanation of the invention as claimed.

BRIEF DESCRIPTION OF THE DRAWINGS

The disclosure can be more fully understood by reading the following detailed description of the embodiments, with reference to the accompanying drawings as follows.

DESCRIPTION OF THE EMBODIMENTS

In the following description, several specific details are presented to provide a thorough understanding of the embodiments of the present invention. One skilled in the relevant art will recognize, however, that the present invention can be practiced without one or more of the specific details, or in combination with or with other components, etc. In other instances, well-known implementations or operations are not shown or described in detail to avoid obscuring aspects of various embodiments of the present invention.

The terms used in this specification generally have their ordinary meanings in the art and in the specific context where each term is used. The use of examples anywhere in this specification, including examples of any terms discussed herein, is illustrative only, and in no way limits the scope and meaning of the invention or of any exemplified term. Likewise, the present invention is not limited to various embodiments given in this specification.

As used herein, the terms "comprising," "including," "having," "containing," "involving," and the like are to be understood to be open-ended, i.e., to mean including but not limited to.

Reference throughout the specification to "one embodiment" or "an embodiment" means that a particular feature, structure, implementation, or characteristic described in connection with the embodiment is included in at least one embodiment of the present invention. Thus, uses of the phrases "in one embodiment" or "in an embodiment" in various places throughout the specification are not necessarily all referring to the same embodiment. Furthermore, the particular features, structures, implementation, or characteristics may be combined in any suitable manner in one or more embodiments.

Figure 1:
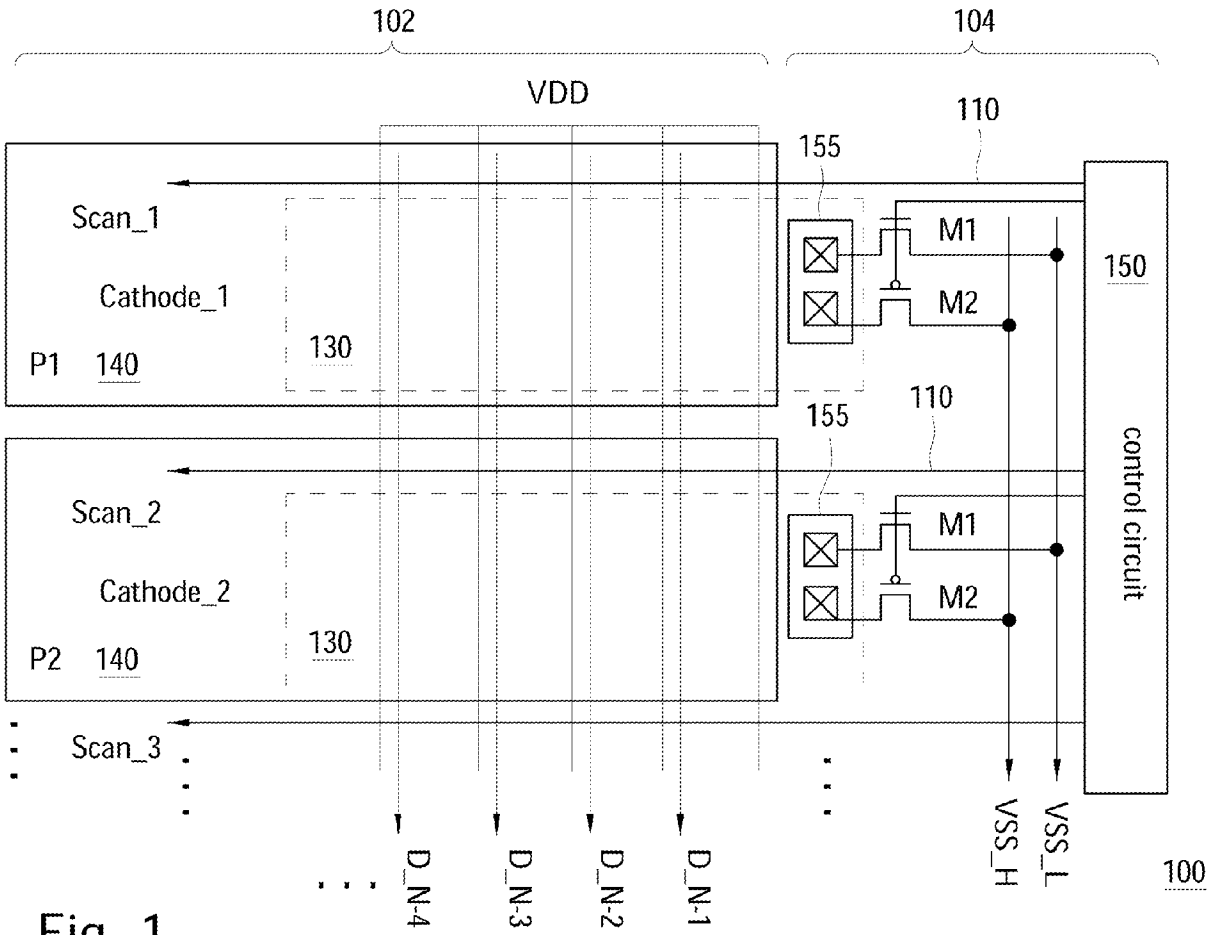
FIG. 1 is a diagram of an organic light emitting display in accordance with one embodiment of the present invention.

FIG. 1 is a diagram of an organic light emitting display in accordance with one embodiment of the present invention. The organic light emitting display 100 includes a plurality of scan lines 110, a plurality of data lines (D_N-1, D_N-2, D_N-3, D_N-4, . . . ), a plurality of row common electrodes (Cathode_1, Cathode_2, . . . ) 130 and a plurality of rows of pixels (P1, P2, . . . ) 140. Hereinafter, each row of the pixels 140 include several pixels in a same row of a pixel array, and the row common electrodes 130 are respectively disposed corresponding to the rows of the pixels 140 to provide corresponding common voltages separately for the rows of the pixels 140.

The scan lines 110 are provided for sequentially transmitting a plurality of scan signals Scan_1, Scan_2, Scan_3, . . . , etc. The row common electrodes 130 are disposed in parallel with the scan lines 110 and provided for sequentially transmitting a plurality of common voltage signals VSS which are corresponding to the scan signals Scan_1, Scan_2, Scan_3, . . . , etc. The rows of the pixels 140 are electrically coupled to the scan lines 110 and the row common electrodes 130 and also sequentially receive the scan signals Scan_1, Scan_2, Scan_3, . . . , etc. and the corresponding common voltage signals VSS.

For example, the first scan line 110 transmits the scan signal Scan_1, the first row common electrode (Cathode_1) 130 transmits the common voltage signal VSS which is corresponding to the scan signal Scan_1, and the first row of the pixels (P1) 140 receive the scan signal Scan_1 and the common voltage signal VSS. After that, the second scan line 110 transmits the scan signal Scan_2, the second row common electrode (Cathode_2) 130 transmits the common voltage signal VSS which is corresponding to the scan signal Scan_2, and the second row of the pixels (P2) 140 receive the scan signal Scan_2 and the common voltage signal VSS; and so on.

In addition, the organic light emitting display 100 illustrated in FIG. 1 may substantially be separated into a pixel region 102 and a peripheral circuit region 104. The pixel region 102 includes the scan lines 110, the data lines (D_N-1, D_N-2, D_N-3, . . . ), the row common electrodes 130 and the rows of the pixels 140. The peripheral circuit region 104 is configured for controlling the pixel region 102 such that devices in the pixel region 102 can operate in sequence. Specifically, the peripheral circuit region 104 includes a control circuit 150 and electrode-driving elements (e.g. transistors M1 and M2), in which the control circuit 150 is configured for controlling the transistors M1 and M2, and the transistors M1 and M2 are electrically coupled between metal contacts 155 and the common voltage signal VSS and also coupled through the metal contacts 155 to the row common electrodes 130.

Moreover, one ends of the transistors M1 and M2 are jointly coupled to the metal contacts 155, and the other ends of the transistors M1 and M2 are respectively coupled to the common voltage signal VSS with a low level (i.e. VSS_L) and the common voltage signal VSS with a high level (i.e. VSS_H). In the present embodiment, the control circuit 150 may include a vertical shift register, and the low-level common voltage signal VSS_L and the high-level common voltage signal VSS_H may be provided by a flexible printed circuit board (FPC) (not shown) in the organic light emitting display 100.

In operation, when the control circuit 150 controls the transistors M1 and M2 according to the scan signals Scan_1, Scan_2, Scan_3, . . . , etc., the low-level common voltage signal VSS_L and the high-level common voltage signal VSS_H are correspondingly provided to the row common electrodes (Cathode_1, Cathode_2, . . . ) 130 according to whether the transistors M1 and M2 are activated or not. For example, in regard to the first row of the pixels (P1) 140, when the scan signal Scan_1 is outputted, the control circuit 150 correspondingly transmits the control signal (e.g. low-level signal) to activate the transistor M2 and deactivate the transistor M1. At that moment, the high-level common voltage signal VSS_H is provided through the transistor M2 and the metal contact 155 to the first row common electrode (Cathode_1) 130, such that the first row common electrode (Cathode_1) 130 transmits the first common voltage signal VSS_H with high level (similar to VSS_N shown in FIG. 6, where N=1) during a data writing period of the first row of the pixels (P1) 140, and the first row of the pixels (P1) 140 are driven by the scan signal Scan_1 which is corresponding to the first common voltage signal VSS_H.

Thereafter, in regard to the second row of the pixels (P2) 140, when the scan signal Scan_2 is outputted, the control circuit 150 correspondingly transmits the control signal (e.g. low-level signal) to activate the transistor M2 and deactivate the transistor M1. At that moment, the high-level common voltage signal VSS_H is provided through the transistor M2 and the metal contact 155 to the second row common electrode (Cathode_2) 130, such that the second row common electrode (Cathode_2) 130 transmits the second common voltage signal VSS_H with high level (similar to VSS_N shown in FIG. 6, where N=2) during a data writing period of the second row of the pixels (P2) 140, and the second row of the pixels (P2) 140 are driven by the scan signal Scan_2 which is corresponding to the second common voltage signal VSS_H. Other rows of the pixels operate similarly thereafter.

Furthermore, the foregoing manner of controlling the transistors M1 and M2 by the control circuit 150 may also be designed in different ways. For instance, the other ends of the transistors M1 and M2 are respectively coupled to the high-level common voltage signal VSS_H and the low-level common voltage signal VSS_L instead. In regard to the first row of the pixels (P1) 140, when the scan signal Scan_1 is outputted, the control circuit 150 correspondingly transmits the control signal (e.g. high-level signal) to activate the transistor M1 and deactivate the transistor M2, and the high-level common voltage signal VSS_H is provided through the transistor M1 and the metal contact 155 to the first row common electrode (Cathode_1) 130; thereafter, in regard to the second row of the pixels (P2) 140, when the scan signal Scan_2 is outputted, the control circuit 150 correspondingly transmits the control signal (e.g. high-level signal) to activate the transistor M1 and deactivate the transistor M2, and the high-level common voltage signal VSS_H is provided through the transistor M1 and the metal contact 155 to the second row common electrode (Cathode_2) 130; and so on.

Therefore, one person skilled in the art is able to modify the foregoing operations of the control circuit 150 controlling the transistors M1 and M2, based on practical manners of the high-level common voltage signal VSS_H and the low-level common voltage signal VSS_L coupled to the transistors M1 and M2, such that the row common electrodes 130 transmit the high-level common voltage signal VSS_H during the data writing periods of the rows of the pixels 140. The manners mentioned above are merely described for convenience but not limiting of the present invention.

Moreover, although the foregoing embodiments illustrate the manner of transmitting the high-level common voltage signal VSS_H during the data writing period, one person skilled in the art is still able to utilize the manner of transmitting the low-level common voltage signal VSS_L (for example, changing the manner of signals VSS_H and VSS_L coupled to the transistors M1 and M2 and also modifying the operations of the control circuit 150 controlling the transistors M1 and M2) for other corresponding circuits according to practical needs. The foregoing embodiments are not limiting of the present invention.

Figure 2:
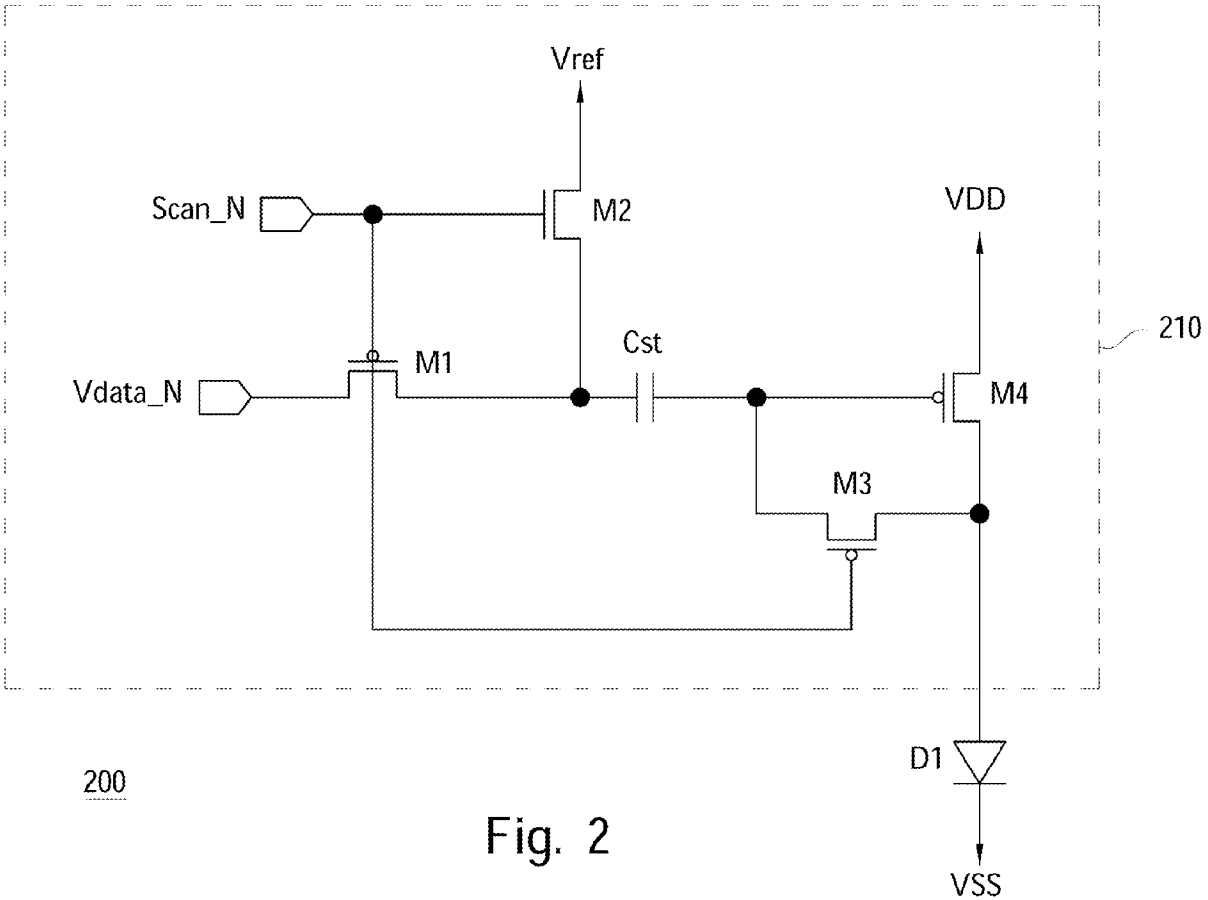
FIG. 2 is a diagram of a pixel circuit in accordance with one embodiment of the present invention.

In the present embodiment, each row of the pixels 140 include several pixels in a same row of the pixel array, so each row of the pixels 140 may further include a plurality of corresponding pixel circuits. FIG. 2 is a diagram of a pixel circuit in accordance with one embodiment of the present invention. Refer to FIG. 1 and FIG. 2 at the same time. The pixel circuit 200 includes a light emitting device (e.g. an organic light emitting diode D1) and a driving unit 210. One end of the diode D1 (e.g. anode) is electrically coupled to the driving unit 210, and the other end of the diode D1 (e.g. cathode) is electrically coupled to one of the row common electrodes 130, such that the diode D1 can receive the common voltage signal VSS during an appropriate period. Specifically, the first row common electrode (Cathode_1) 130 has a high-level common voltage during the data writing period of the first row of the pixels (P1) 140 so as to reverse bias the corresponding diode D1; the second row common electrode (Cathode_2) 130 has a high-level common voltage during the data writing period of the second row of the pixels (P2) 140 so as to reverse bias the corresponding diode D1; and so on.

In other words, the rows of the pixels (P1, P2, P3, . . . ) 140 receive the scan signals Scan_1, Scan_2, Scan_3, . . . , etc. and the corresponding common voltage signals row by row, such that the driving unit 210 in each row of the pixels 140 is controlled by a corresponding signal of the scan signals Scan_1, Scan_2, Scan_3, . . . , etc., and the light emitting devices (e.g. organic light emitting diode D1) in each row of the pixels 140 are reverse biased by a corresponding signal of the common voltage signals.

The driving unit 210 is configured for driving the diode D1 and includes a storage capacitor Cst, a driving transistor M4 (conventionally thin-film transistor) and switches M1, M2 and M3, in which M1, M3 and M4 may be PMOS transistors, M2 may be an NMOS transistor, and specific connections of the storage capacitor Cst, the driving transistor M4 and the switches M1, M2 and M3 are illustrated in FIG. 2.

Substantially, the driving transistor M4 is coupled between a power supply VDD and the anode of diode D1, and the control terminal of driving transistor M4 is electrically coupled to one end of the storage capacitor Cst. The switch M3 is activated by the scan signal Scan_N and thus conducts the control terminal of driving transistor M4 and a terminal, which is coupled to the anode of diode D1, of driving transistor M4. The switch M1 is activated by the scan signal Scan_N and thus couples a data voltage Vdata to another end of the storage capacitor Cst. The switch M2 is activated during a display period of a corresponding row of the pixels and thus couples a reference voltage Vref to the storage capacitor Cst.

Since each row of the pixels 140 may include several pixel circuits 200, each row of the pixels 140 may include several corresponding light emitting devices (e.g. organic light emitting diode D1) and several driving units 210, and each of the driving units 210 may include the storage capacitor Cst, the driving transistor M4 and the switches M1, M2 and M3. The pixel circuits 200 in different rows of the pixels (P1, P2, . . . ) 140, however, operate according to different scan signals Scan_1, Scan_2, . . . , etc. For example, the pixel circuits 200 in the first row of the pixels (P1) 140 are activated by the first scan signal Scan_1, such that the diodes D1 in the pixel circuits 200 in the first row of the pixels (P1) 140 emit light and images are thus displayed. Then, the pixel circuits 200 in the second row of the pixels (P2) 140 are activated by the second scan signal Scan_2, such that the diodes D1 in the pixel circuits 200 in the second row of the pixels (P2) 140 emit light and images are thus displayed; and so on.

Figure 3:
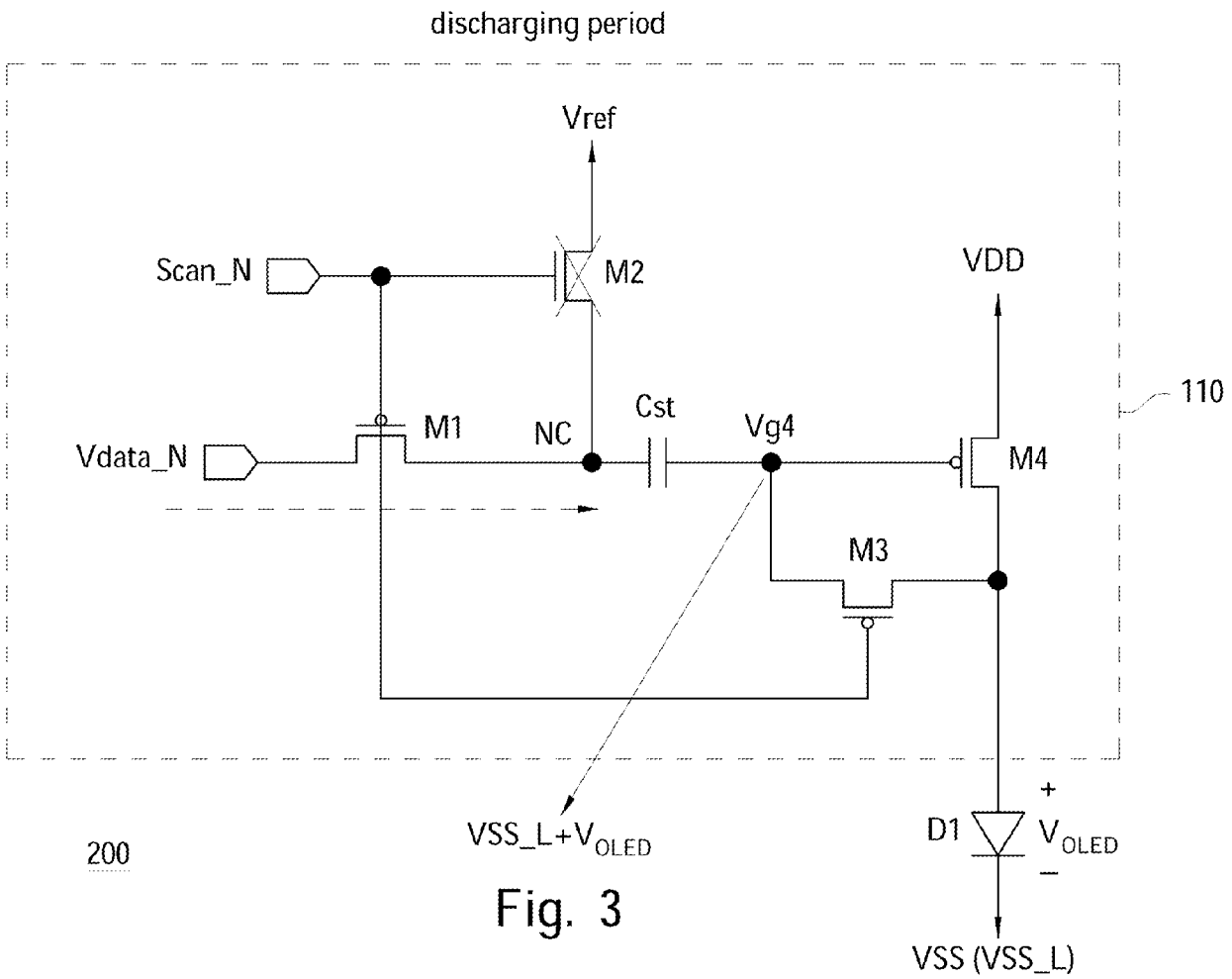
FIGS. 3-5 are operation diagrams of the pixel circuit shown in FIG. 2, in accordance with one embodiment of the present invention.
Figure 4:
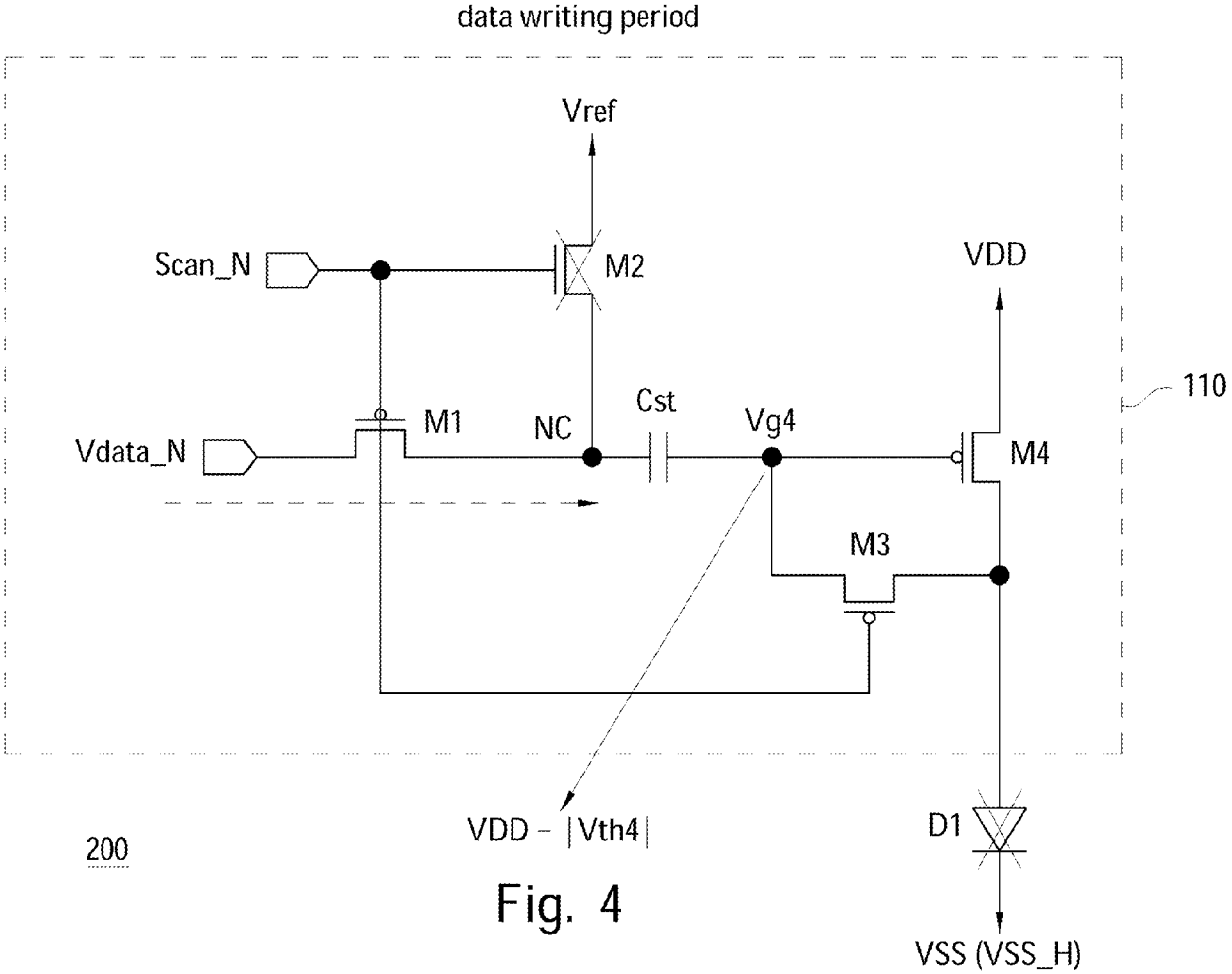
Figure 5:
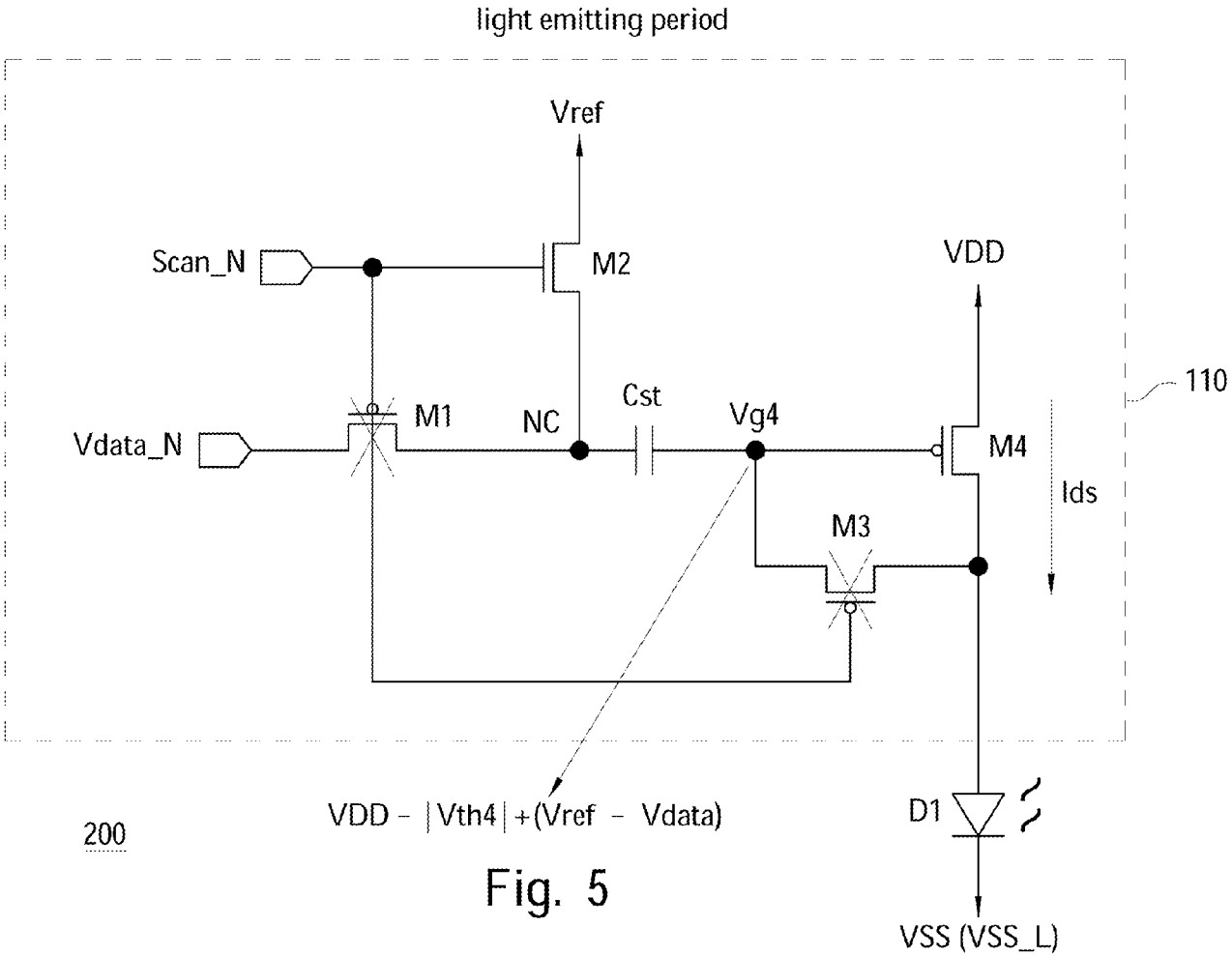
Figure 6:
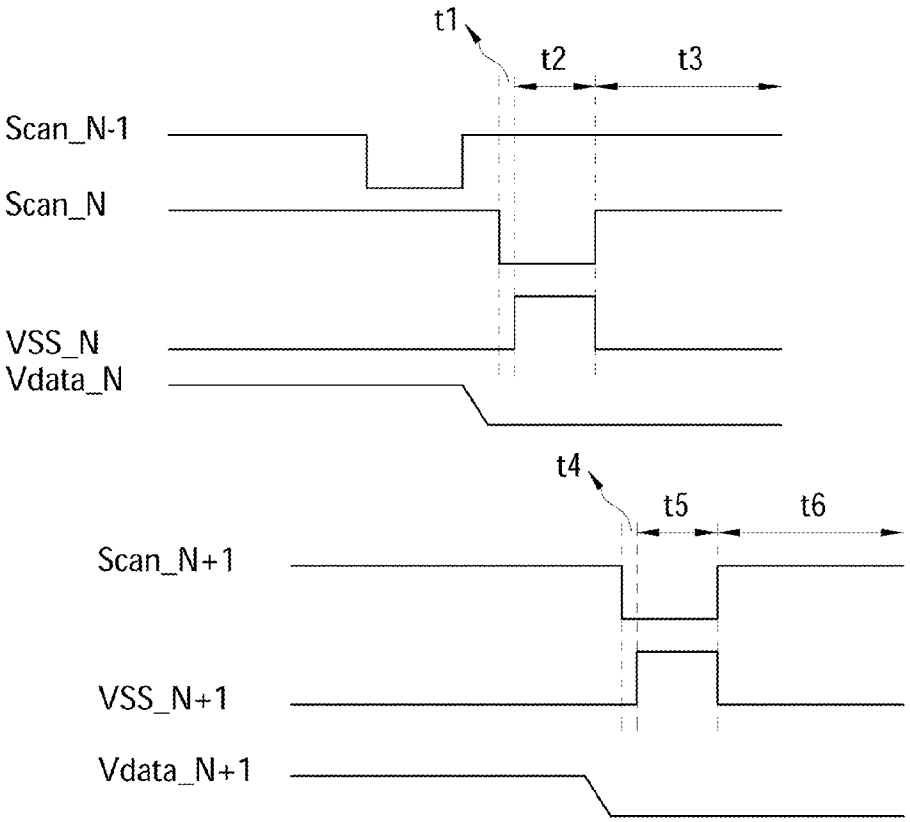
FIG. 6 is a driving waveform of the scan signals and the common voltage signals operating during different periods in accordance with one embodiment of the present invention.

FIGS. 3-5 are operation diagrams of the pixel circuit shown in FIG. 2, in accordance with one embodiment of the present invention. FIG. 6 is a driving waveform of the scan signals and the common voltage signals operating during different periods in accordance with one embodiment of the present invention. Refer to FIGS. 3-5 and FIG. 6 at the same time. Hereinafter, for convenience, FIGS. 3-5 are discussed by an example of a pixel circuit in the N-th row of the pixels.

In FIG. 3, during a period t1 (hereinafter referred to as discharging period), the scan signal Scan_N is at a low-level state and the common voltage signal VSS_N is also at a low-level state (VSS_L). At the moment, the switch M2 is deactivated, the switch M1 is activated such that the data signal Vdata_N is transmitted through the switch M1 to the storage capacitor Cst, resulting in that the node NC has a voltage level Vdata that is corresponding to the data signal Vdata_N. The diode D1 is thus at a forward bias state according to the low-level common voltage signal VSS_L. The switch M3 is thus activated so that the voltage level of node Vg4 is pulled down to a relatively low voltage level. As a result, the node Vg4 can thus be pulled down to the relatively low voltage level during the period t1, so as to perform the reset operation, such that the current variation can remain consistent while the circuits operate sequentially, in order to avoid hysteresis phenomenon for affecting the current curve and to further prevent the displayed image from having a retained image.

Thereafter in FIG. 4, during a period t2 (hereinafter referred to as data writing period), the scan signal Scan_N is still at the low-level state and the common voltage signal VSS_N changes to be at a high-level state (VSS_H). At the moment, the switch M2 is still deactivated, the switches M1 and M3 are still activated, the diode D1 is thus at a reverse bias state according to the high-level common voltage signal VSS_H, and the transistor M4 would be activated such that the voltage level of the node Vg4 is charged to VDD−|Vth4| via the transistor M4, in which Vth4 represents the threshold voltage of the transistor M4.

Then in FIG. 5, during a period t3 (hereinafter referred to as light emitting period), the scan signal Scan_N changes to be at the high-level state and the common voltage signal VSS_N changes to be at the low-level state (VSS_L). At the moment, the switches M1 and M3 are deactivated, the switch M2 is activated such that the voltage level of the node NC is pulled up to the reference voltage Vref via the switch M2, and the diode D1 is at the forward bias state according to the low-level common voltage signal VSS_L. Since the voltage level of the node NC has the variation of Vref−Vdata, the voltage level of the node Vg4 has the same variation as well, resulting in that the voltage level of the node Vg4 increases to VDD−|Vth4|+Vref−Vdata and the transistor M4 is activated to generate a driving current Ids for driving the diode D1 to emit light.

It is noticed that during the light emitting period the value of the driving current Ids can be derived from the equations as follows:

$$\begin{aligned} Ids &= 1/2\cdot\beta\cdot(Vsg4-|Vth4|)^2 \\ &= 1/2\cdot\beta\cdot(Vs4-Vg4-|Vth4|)^2 \\ &= 1/2\cdot\beta\cdot\{VDD-(VDD-|Vth4|+Vref-Vdata)-|Vth4|\}^2 \\ &= 1/2\cdot\beta\cdot(Vdata-Vref)^2 \end{aligned}$$

Thus the value of the driving current Ids can be represented by $\frac{1}{2}\cdot\beta\cdot(Vdata-Vref)^2$ and has no direct relation with the power supply VDD and the threshold voltage Vth4 of the transistor M4. Consequently, it can be avoided that the driving currents Ids in the pixels are different from each other due to IR-drop caused by the power supply VDD, or that the threshold voltages Vth4 of the transistors M4 in the pixels are different from each other, due to the variation of the fabrication process, such that the driving currents Ids in the pixels are also different from each other.

Figure 7:
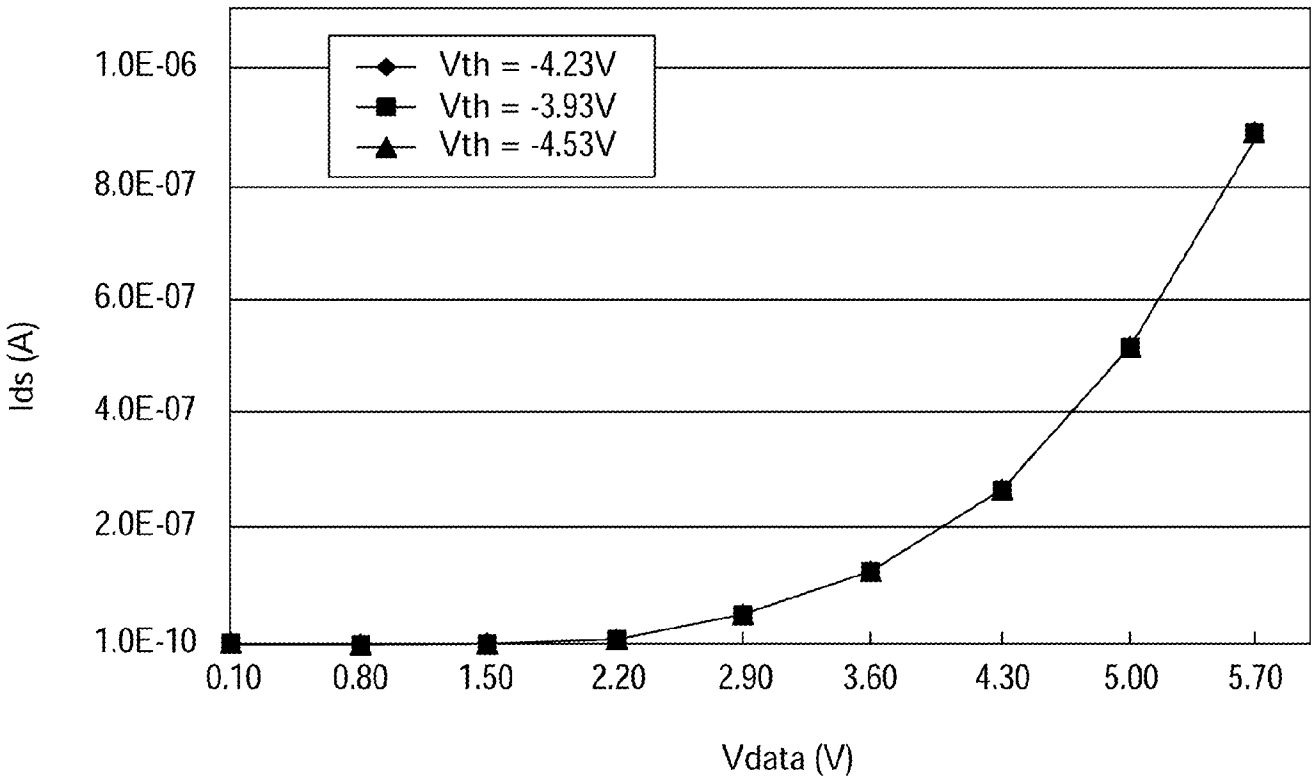
FIG. 7 is a simulation result of variation of the driving current in relation to the data signal in the conditions of the thin-film transistor having various threshold voltages, in the pixel circuit shown in FIG. 2.

FIG. 7 is a simulation result of variation of the driving current in relation to the data signal in the conditions of the thin-film transistor having various threshold voltages, in the pixel circuit shown in FIG. 2. As shown in FIG. 7, in the conditions of the threshold voltages (Vth) being −4.23V, −3.93V and −4.53V, respectively, while the voltage level Vdata corresponding the data signal changes, the driving current Ids remain changing with only Vdata and would not be affected by various threshold voltages.

On the other hand, after operations of the pixel circuits in the N-th row of the pixels are completed, then the pixel circuits in the (N+1)-th row of the pixels will operate according to the scan signal Scan_N+1, the common voltage signal VSS_N+1 and the data signal Vdata_N+1 during the discharging period t4, the data writing period t5 and the light emitting period t6, respectively, like the pixel circuits in the N-th row of the pixels.

As can be known from FIG. 1 and FIGS. 3-6, in the embodiments of the present invention, the pixel circuits 200 in different rows of the pixels (P1, P2, . . . ) 140 would operate according to the received scan signals and the common voltage signals, in which the scan signals and the common voltage signals have a delay time therebetween (t1, t4 shown in FIG. 6) and levels of the scan signals are opposite to levels of the common voltage signals during the data writing period (t2, t5 shown in FIG. 6). For example, the level of the first scan signal Scan_1 is opposite to the level of the first common voltage signal VSS_1; the level of the second scan signal Scan_2 is opposite to the level of the second common voltage signal VSS_2; and so on. The foregoing relation between the scan signal and the common voltage signal is mainly based on the architecture of the pixel circuit, thus one person skilled in the art may modify the relation between the scan signal and the common voltage signal according to the practice within the spirit and scope of the appended claims.

On the other hand, a method for driving the organic light emitting display is also provided in the embodiment of the present invention. Refer to FIG. 1, FIG. 2 and FIG. 6 at the same time. First, the first scan signal Scan_1 is transmitted to control the driving units 210 in the first row of the pixels (P1) 140. Then, the first common voltage signal VSS_1 corresponding to the first scan signal Scan_1 is transmitted to reverse bias the light emitting devices (e.g. organic light emitting diode D1) in the first row of the pixels (P1) 140. After that, the first scan signal Scan_1 is de-asserted and the second scan signal Scan_2 is transmitted to control the driving units 210 in the second row of the pixels (P2) 140. Thereafter, the first common voltage signal VSS_1 is de-asserted and the second common voltage signal VSS_2 corresponding to the second scan signal Scan_2 is transmitted to reverse bias the light emitting devices (e.g. organic light emitting diode D1) in the second row of the pixels (P2) 140.

In the present embodiment, when the first scan signal Scan_1 is outputted, the first common voltage signal VSS_1 is immediately and correspondingly outputted, both of which have a very short delay time therebetween (t1 shown in FIG. 6), and the levels of the two signals are opposite to each other. Similarly, when the second scan signal Scan_2 is outputted, the second common voltage signal VSS_2 is immediately and correspondingly outputted, both of which have a very short delay time therebetween (t4 shown in FIG. 6), and the levels of the two signals are opposite to each other.

Thereafter, the second scan signal Scan_2 is de-asserted and the third scan signal Scan_3 is transmitted to control the driving units 210 in the third row of the pixels (P2) 140. Then, the second common voltage signal VSS_2 is de-asserted and the third common voltage signal VSS_3 corresponding to the third scan signal Scan_3 is transmitted to reverse bias the light emitting devices (e.g. organic light emitting diode D1) in the third row of the pixels (P3) 140.

In the present embodiment, when the third scan signal Scan_3 is outputted, the third common voltage signal VSS_3 is immediately and correspondingly outputted, both of which have a very short delay time therebetween, and the levels of the two signals are opposite to each other.

Therefore, the driving units 210 and the light emitting devices in other rows of the pixels (PN) 140 operate according to the scan signals Scan_N and the corresponding common voltage signals VSS_N. The driving units 210 and the light emitting devices in the first row of the pixels (P1) 140 then selectively start to operate in sequence until operations of the driving units 210 and the light emitting devices in the last row of the pixels (PN) 140 are completed.

For the foregoing embodiments of the present invention, each row common electrode is disposed with respect to one row of the pixels, so the row common electrodes can provide corresponding common voltages respectively for corresponding rows of the pixels during the operation periods. Compared to the prior art that a single common electrode is disposed corresponding to all pixels, the embodiments of the present invention can be provided such that the pixel circuits in the pixels operate correspondingly.

In addition, the row common electrodes sequentially provide the common voltages respectively for the corresponding rows of the pixels during the corresponding operation periods, so the embodiments of the present invention can be provided such that the pixel circuits in the pixels operate correspondingly, compared to the prior art that a single fixed common voltage is provided for the pixel circuits in the pixels.

Moreover, the driving currents in the pixel circuits have no relation with the power supply and the threshold voltages of the driving transistors, so it can be avoided that the driving currents Ids in the pixels are different from each other due to power voltage drop (IR-drop) caused by the power supply VDD, or that the threshold voltages of the driving transistors in the pixels are different from each other, due to the variation of the fabrication process, such that the driving currents Ids in the pixels are also different from each other.

The steps are not recited in the sequence in which the steps are performed. That is, unless the sequence of the steps is expressly indicated, the sequence of the steps is interchangeable, and all or part of the steps may be simultaneously, partially simultaneously, or sequentially performed.

As is understood by a person skilled in the art, the foregoing embodiments of the present invention are illustrative of the present invention rather than limiting of the present invention. It is intended to cover various modifications and similar arrangements included within the spirit and scope of the appended claims, the scope of which should be accorded with the broadest interpretation so as to encompass all such modifications and similar structures.

What is claimed is:

1. An organic light emitting display, comprising:

a plurality of scan lines for sequentially transmitting a plurality of scan signals;

a plurality of row common electrodes disposed in parallel with the scan lines, for sequentially transmitting a plurality of common voltage signals corresponding to the scan signals; and a plurality of rows of pixels electrically coupled to the scan lines and the row common electrodes, for sequentially receiving the scan signals and the corresponding common voltage signals, wherein the row common electrodes reverse bias at least one light emitting device of the rows of pixels during a data writing period.

2. The organic light emitting display as claimed in claim 1, wherein the rows of pixels comprises:

a first row of the pixels comprising a plurality of first pixel circuits, at least one of the first pixel circuits comprising:

a first light emitting device having an end electrically coupled to a first row common electrode of the row common electrodes; and a first driving unit for driving the first light emitting device; and a second row of the pixels comprising a plurality of second pixel circuits, at least one of the second pixel circuits comprising:

a second light emitting device having an end electrically coupled to a second row common electrode of the row common electrodes; and a second driving unit for driving the second light emitting device.

3. The organic light emitting display as claimed in claim 2, wherein the first row common electrode transmits a first common voltage signal of the common voltage signals during a data writing period of the first row of the pixels, and the second row common electrode transmits a second common voltage signal of the common voltage signals during a data writing period of the second row of the pixels.

4. The organic light emitting display as claimed in claim 3, wherein when the first row common electrode transmits the first common voltage signal, the first row of pixels are driven by a first scan signal corresponding to the first common voltage signal, of the scan signals, and when the second row common electrode transmits the second common voltage signal, the second row of pixels are driven by a second scan signal corresponding to the second common voltage signal, of the scan signals.

5. The organic light emitting display as claimed in claim 4, wherein the first row common electrode reverse biases the first light emitting device during the data writing period of the first row of the pixels, and the second row common electrode reverse biases the second light emitting device during the data writing period of the second row of the pixels.

6. The organic light emitting display as claimed in claim 2, wherein the first driving unit further comprises:

a first storage capacitor;

a first driving transistor coupled between another end of the first light emitting device and a power supply, a control terminal of the first driving transistor being electrically coupled to an end of the first storage capacitor;

a first switch activated by a first scan signal of the scan signals to conduct the control terminal and a first terminal of the first driving transistor;

a second switch activated by the first scan signal to couple a first data voltage to another end of the first storage capacitor; and a third switch activated during a display period of the first row of the pixels to couple a first reference voltage to the first storage capacitor.

7. The organic light emitting display as claimed in claim 6, wherein the second driving unit further comprises:

a second storage capacitor;

a second driving transistor coupled between another end of the second light emitting device and the power supply, a control terminal of the second driving transistor being electrically coupled to an end of the second storage capacitor;

a fourth switch activated by a second scan signal of the scan signals to conduct the control terminal and a first terminal of the second driving transistor;

a fifth switch activated by the second scan signal to couple a second data voltage to another end of the second storage capacitor; and a third switch activated during a display period of the second row of the pixels to couple a second reference voltage to the second storage capacitor.

8. The organic light emitting display as claimed in claim 7, wherein the first row common electrode transmits a first common voltage signal corresponding to the first scan signal, of the common voltage signals, the second row common electrode transmits a second common voltage signal corresponding to the second scan signal, of the common voltage signals.

9. The organic light emitting display as claimed in claim 8, wherein a level of the first scan signal is opposite to a level of the first common voltage signal, and a level of the second scan signal is opposite to a level of the second common voltage signal.

10. The organic light emitting display as claimed in claim 8, wherein the first light emitting device is reverse biased by the first common voltage signal, and the second light emitting device is reverse biased by the second common voltage signal.

11. The organic light emitting display as claimed in claim 2, further comprising:

a plurality of electrode-driving elements correspondingly coupled between the row common electrodes and a common voltage; and a control circuit for sequentially activating the electrode-driving elements in accordance with the scan signals such that the common voltage is coupled sequentially to the row common electrodes through the electrode-driving elements.

12. A method for driving an organic light emitting display, the organic light emitting display comprising a plurality of rows of pixels, each row of the pixels comprising a plurality of driving units and a plurality of light emitting devices, wherein the driving units are configured for driving the light emitting devices, the method comprising:

transmitting a first scan signal to control the driving units in a first row of the pixels;

transmitting a first common voltage signal corresponding to the first scan signal to reverse bias the light emitting devices in the first row of the pixels during data writing period;

de-asserting the first scan signal and transmitting a second scan signal to control the driving units in a second row of the pixels; and de-asserting the first common voltage signal and transmitting a second common voltage signal corresponding to the second scan signal to reverse bias the light emitting devices in the second row of the pixels.

13. The method as claimed in claim 12, wherein a level of the first scan signal is opposite to a level of the first common voltage signal, and a level of the second scan signal is opposite to a level of the second common voltage signal.

14. The method as claimed in claim 12, wherein the first scan signal and the first common voltage signal have a delay time therebetween, and the second scan signal and the second common voltage signal have another delay time therebetween.

15. The method as claimed in claim 12, further comprising:

de-asserting the second scan signal and transmitting a third scan signal to control the driving units in a third row of the pixels; and de-asserting the second common voltage signal and transmitting a third common voltage signal corresponding to the third scan signal to reverse bias the light emitting devices in the third row of the pixels.

16. The method as claimed in claim 15, wherein the first common voltage signal, the second common voltage signal and the third common voltage signal are generated sequentially according to the first scan signal, the second scan signal and the third scan signal, and respectively have a delay time relative to the first scan signal, the second scan signal and the third scan signal.

17. An organic light emitting display, comprising:

a plurality of scan lines for sequentially transmitting a plurality of scan signals;

a plurality of row common electrodes disposed in parallel with the scan lines, for sequentially transmitting a plurality of common voltage signals generated in accordance with the scan signals; and a plurality of rows of pixels electrically coupled to the scan lines and the row common electrodes, each row of the pixels comprising:

a plurality of light emitting devices, first ends of the light emitting devices being electrically coupled to one of the row common electrodes; and a plurality of driving units for driving the light emitting devices;

wherein the rows of the pixels receive the scan signals and the corresponding common voltage signals row by row, such that the driving units in each row of the pixels are controlled by a corresponding one of the scan signals and the light emitting devices in each row of the pixels are reverse biased by a corresponding one of the common voltage signals during corresponding data writing periods.

18. The organic light emitting display as claimed in claim 17, wherein the row common electrodes transmit the common voltage signals during corresponding data writing periods of the rows of the pixels.

19. The organic light emitting display as claimed in claim 17, wherein each of the driving units further comprises:

a storage capacitor;

a driving transistor coupled between a second end of a corresponding one of the light emitting devices and a power supply, a control terminal of the driving transistor being electrically coupled to an end of the storage capacitor;

a first switch activated by a corresponding one of the scan signals to conduct the control terminal and a first terminal of the driving transistor;

a second switch activated by the corresponding one of the scan signals to couple a first data voltage to another end of the storage capacitor; and a third switch activated during a display period of one corresponding row of the pixels to couple a reference voltage to the storage capacitor.

20. The organic light emitting display as claimed in claim 17, further comprising:

a plurality of electrode-driving elements correspondingly coupled between the row common electrodes and a common voltage; and a control circuit for sequentially activating the electrode-driving elements in accordance with the scan signals such that the common voltage is coupled sequentially to the row common electrodes through the electrode-driving elements.

21. The organic light emitting display as claimed in claim 17, wherein levels of the scan signals are opposite to levels of the corresponding common voltage signals.

* * * * *